US006357203B1

(12) United States Patent
Cicha et al.

(10) Patent No.: US 6,357,203 B1
(45) Date of Patent: Mar. 19, 2002

(54) TOP PRE-FOLDING APPARATUS FOR AN EXTENDED TOP PANEL GABLE TOP CARTON

(75) Inventors: John Cicha, Shoreview; Jonathan Buesing, Maplewood, both of MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 30 days.

(21) Appl. No.: 09/608,873

(22) Filed: Jun. 30, 2000

(51) Int. Cl.[7] ..... B65B 7/20

(52) U.S. Cl. ..... 53/370.6; 53/426; 53/467; 53/564; 493/70; 493/163; 493/184

(58) Field of Search ..... 53/370.6, 372.4, 53/372.5, 374.5, 375.4, 376.2, 376.4, 426, 467, 468, 476, 484, 564; 493/70–73, 76, 79, 163, 165–167, 174–175, 176, 178, 177, 183, 184

(56) References Cited

U.S. PATENT DOCUMENTS 3,120,089 A 2/1964 Monroe et al.
3,187,646 A 6/1965 Monroe et al.
3,486,423 A 12/1969 Mistarz
3,785,113 A * 1/1974 Martensson et al. ..... 53/186
4,215,522 A * 8/1980 Clift et al. ..... 53/378
5,167,607 A 12/1992 Larsen
5,234,398 A * 8/1993 Larsen ..... 493/183
5,588,279 A * 12/1996 Runnberg et al. ..... 53/426
5,809,743 A * 9/1998 Ylonen et al. ..... 53/370.6

* cited by examiner

*Primary Examiner*—Rinaldi I. Rada
*Assistant Examiner*—Hemant M Desai
(74) *Attorney, Agent, or Firm*—Welsh & Katz, Ltd.

(57) ABSTRACT

A top panel pre-folder for a form, fill and seal packaging machine for forming, filling and sealing an extended top panel gable top carton includes an mandrel positioned along the machine processing path that is movable from above the carton to the interior of the carton as the carton moves along the processing path. A pair of spaced apart pivotal arms, each disposed on opposing sides of the mandrel and transverse to the processing path, is pivotal about an axis toward and away from the mandrel. Each arm includes a flap mounted thereto having a raised portion extending from a face of the flap. The arms pivot to contact the flaps with gable side panels of the carton to infold the gable side panels inwardly over the mandrels. The flap raised portions contact the gable side panels at about gable side panel/vertical side panel junctures.

10 Claims, 4 Drawing Sheets

TOP PRE-FOLDING APPARATUS FOR AN EXTENDED TOP PANEL GABLE TOP CARTON

FIELD OF THE INVENTION

This invention is directed to an apparatus for pre-folding the top panels of a gable-top carton. More specifically, the invention pertains to a top pre-folding apparatus for pre-folding the top gable panels of a carton having an extended top panel.

BACKGROUND OF THE INVENTION

Gable top cartons are in widespread use. Such cartons have been known for most of the twentieth century. These cartons have gained widespread acceptance and popularity as cartons for traditional products, such as liquid food products, for example milk and juice. These cartons are also used for packaging non-liquid food items, such as dried and particulate soups and for non-food items, such as laundry detergent.

Early traditional gable top cartons included a pour-spout that was formed by opening a portion of one side of the gable. While this configuration was and still is widely accepted, one drawback is that resealability of the carton is limited. That is, while the gable can be "refolded" to close the carton, actual sealing to reduce exposure to the environment, is quite limited. To this end, improvements to such gable top cartons are ongoing.

In one such improvement, a spout is provided on one of the gable panels and is integrally sealed thereto. The spout provides ready access to the packaged product. In a "traditional" spout arrangement, an opening is formed in the gable panel and a plastic or like spout is welded or sealed to the panel. A cap, such as a threaded closure or a hinged closure is fitted to the spout to provide resealability of the container. Such spouts have come into widespread use and ready acceptance for their ease of access to the product and their ability to help maintain product freshness.

In still another enhancement to the gable top carton, it has been found that it is desirable to provide an extended gable or top panel. The extended panel can provide additional area for marketing or advertising print and can be configured to permit the use of larger spouts and or caps. Use of larger spouts can be particularly advantageous for more viscous or solids-containing products. Additionally, these extended top panels provide an aesthetic appeal and distinctive appearance compared to "traditional" gable top cartons. To this end, these enhanced designs have been found to be desirable for all packaged products.

Due to the nature of these extended top panels, it has been found that the typical pre-folding arrangements for pre-folding the top panels and in particular the extended gable panel, do not produce the desired pre-folds of these panels. It has also been found that the known pre-folders may not properly pre-fold the various carton top panels and that "dimples" or indented regions can form at various panel junctures.

Accordingly, there exists a need for an improved top panel pre-folder apparatus for use with gable top cartons. This is particularly true for gable top cartons having extended or enlarged top panels. Desirably, such a top pre-folder permits the forming of the necessary folds in the enhanced gable configuration.

SUMMARY OF THE INVENTION

A top panel pre-folder for a form, fill and seal packaging machine for forming, filling and sealing extended top panel gable top cartons provides the requisite forming or pre-folding of the various top panel creases necessary for the enhanced gable configuration. The machine defines a processing path along which the cartons are conveyed. The top pre-folder is disposed subsequent to bottom panel folding and sealing, and prior to a filling station along the machine processing path.

The gable top carton includes a sealed bottom, a pair of vertical side panels, and a pair of gable side panels. Each of the gable side panels is contiguous with a respective one of the vertical side panels to define a pair of gable side panel/vertical side panel junctures. In the extended top panel arrangement, the gable side panel/vertical side panel junctures are formed at an angle relative to the sealed bottom (e.g., at an angle relative to the horizontal).

The pre-folder includes a pair of pivotal arms and a mandrel positioned along the processing path. The mandrel is movable between a position above the carton and a position interior of the carton as the carton moves along the processing path. The arms are disposed on opposing sides of the mandrel and are mounted transverse to the processing path. Each arm pivots about an axis. The arms each include a flap mounted thereto.

The flaps are mounted to the arms to rotate through an arcuate path toward and away from the mandrel. Preferably, the flaps are triangular in shape and include a raised portion extending from a face of the flap at a lower region of the flap. Most preferably, the flaps are mounted to the arm, spaced from the axis of rotation of the arm.

The arms pivot to move the flaps into engagement with the gable side panels. This infolds the gable side panels inwardly over the mandrels. The flap raised portions contact the gable side panels at about the gable side panel/vertical side panel junctures. This provides a precise pre-folding or "breaking" of the carton crease lines to impart clean, distinct fold lines in the formed and sealed carton.

In a preferred embodiment, the pivotal arm axes are disposed at an angle relative to the horizontal. Most preferably, the pivotal arm axes are disposed at an angle about equal to the angle at which the gable side panel/vertical side panel junctures are formed relative to the horizontal.

In a present machine, each mandrel defines a pair of head portions and the head portions each define a fold edge. In this arrangement, the fold edges are formed generally parallel to their respective pivotal arm axes.

To meet the need for increase operating speeds and processing efficiency, the machine can include multiple pairs of pivotal arms and mandrels. In such an arrangement, the pairs of arms can be disposed on opposing sides of the processing path and their associated mandrels can be positioned directly above the processing path.

In a current embodiment, each pair of pivotal arms and its associated mandrel are carried by a reciprocating carriage. The carriage provides for unitarily moving the arms and mandrel into and out of engagement with the cartons. The carriages carrying the arms and mandrels are configured to reciprocate vertically to move the arms and mandrels into and out of engagement with the cartons below.

Other features and advantages of the present invention will be apparent from the following detailed description, the accompanying drawings and the appended claims.

DETAILED DESCRIPTION OF THE PREFERRED EMBODIMENTS

Figure 1:
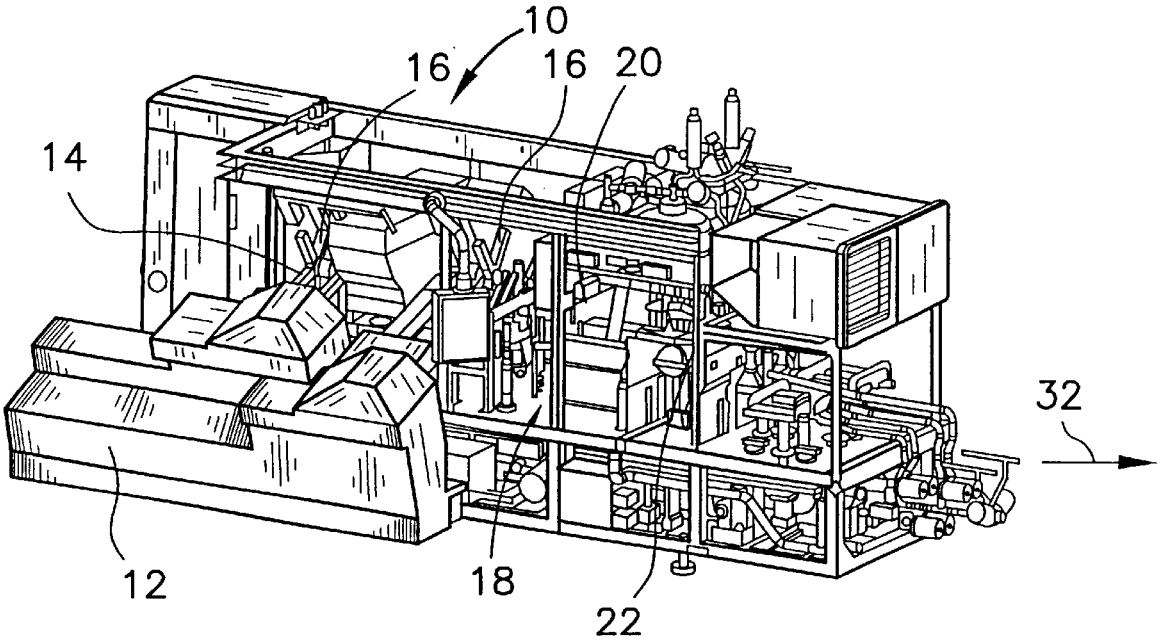
FIG. 1 is a perspective view of an exemplary form, fill and seal packaging machine having an enhanced top pre-folding apparatus in accordance with the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown an exemplary form, fill and seal packaging machine 10. One example of the packaging machine is disclosed in U.S. Pat. No. 6,012,267 to Katsumata which patent is incorporated herein by reference. The packaging machine includes a carton magazine 12 for storing flat, folded carton blanks, a carton erection station 14 and a bottom forming and sealing station 16. The machine includes a pre-folder illustrated generally at 18.

The machine 10 can further include a sterilization station 20 for sterilizing the cartons and further includes a filling station 22 at which the cartons are filled with product. Following the filling station 22, the cartons' top panels are folded and subsequently sealed. The cartons are then off-loaded from the form, fill and seal packaging machine 10.

For purposes of the present disclosure, reference numerals are provided for the cartons 110, 310 in the detailed discussion that follows pertaining to the specific cartons 110, 310.

In the paper converting process, the laminated paperboard cartons are cut to the desired shape for the carton blank, and the fold or crease lines are formed in the laminated structure by a process much like embossing. Those skilled in the art will appreciate and understand the methods for forming these cease or fold lines.

Figure 5A:
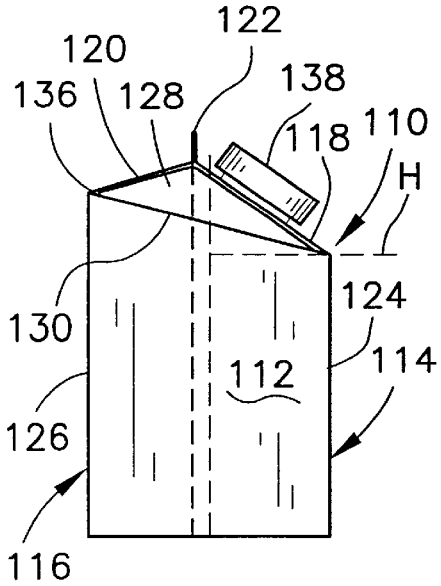
FIGS. 5*a* and 5*b* are side views of two exemplary embodiments of extended top panel gable top cartons.

Referring to FIGS. 5*a,* 6 and 7, the present discussion is directed to carton 110 and its blank form 210. Subsequent to the converting process, the only fold or crease lines that are further manipulated are those necessary to form the flat, folded configuration (not shown). As will be recognized by those skilled in the art, in this configuration, the second and third panels 212, 214 and the fourth and fifth panels 216, 218 are folded over their respective shared fold or crease lines 220, 222 so that the side seal for the carton (at the fifth panel 218) can be made. This flat, folded configuration is that configuration in which the cartons are supplied to the packagers. All subsequent folds and seals are carried out as part of the packaging machine operation.

To this end, the machine 10 includes a pre-folder 18 to pre-fold or "break" the carton fold lines at the various top panel 224*a–e* junctures, such as at the top panel-side panel 212, 214-front panel 214-rear panel 226 junctures. The top panel pre-folder 18 is positioned prior to the filling station 22 and subsequent the bottom panel forming and sealing station 16. The pre-folder 18 provides clean, distinct precursor crease lines (prior to folding and sealing the top panels) by "breaking" the panel junctures at the fold or crease lines.

As discussed above, enhancements in the design of gable top cartons have been ongoing. In one such enhancement, the conventional gable panels of a gable top carton are replaced by "extended" top panels. In such an arrangement, one of the gable panels is extended or elongated. Exemplary extended top panel cartons 110, 310 are illustrated in FIGS. 5*a* and 5*b,* respectively.

As can be seen from these drawings, in the configuration shown in FIG. 5*a,* the carton 110 includes opposing side walls 112 (one shown), a front wall 114 and a rear wall 116 that define the overall rectangular cross-sectional shape of the carton 110. The carton 110 includes an extended top or gable panel 118, a second lesser top (or gable) panel 120 and a top fin 122. Edges 124 define the juncture or intersection of the front wall 114 and respective side walls 112. Likewise, edges 126 define the intersection of the rear wall 126 and respective side walls 112.

In this extended panel configuration, an inner gable portion 128 (one shown) is formed on each side of the carton 110 above the side walls 112 and below and between the extended and lesser top panels 118, 120. To this end, slanted or angled edges 130 define the intersection of each triangular gable side panel 132 and its respective vertical side wall or panel 112. Angled edges 130 correspond to crease lines 232 in the carton blank 210. A front edge 134 defines the intersection of the extended top panel 118 and the front wall 114, and a rear edge 136 defines the intersection of the second lesser top panel 120 and the rear wall 116. The carton 110 can be, and preferably is fitted with a resealable closure, such as the exemplary spout 138.

Figure 5B:
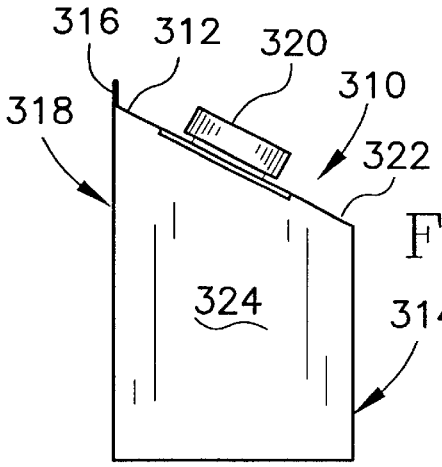

The carton embodiment 310 illustrated in FIG. 5*b* includes a single extended top panel 312 rising from the front wall 314 and forming the fin 316 with a portion of the rear wall 318 of the carton 310. This carton 310 can also include a resealable closure 320. Both of these carton embodiments 110, 310 include angled edges 130, 322 that are formed at the top of the vertical side panels 112, 324. In both of these embodiments of the extended top panel carton, the carton configuration provides a rather distinct aesthetic appeal as well as an extended or elongated panel 118, 312 to, for example, accommodate an oversized spout, closure, cap or the like. Those skilled in the art will recognize that the present pre-folder can be used with various types, sizes and shapes of cartons. All such applications of the present pre-folder 18 are within the scope and spirit of the present invention.

Figure 3:
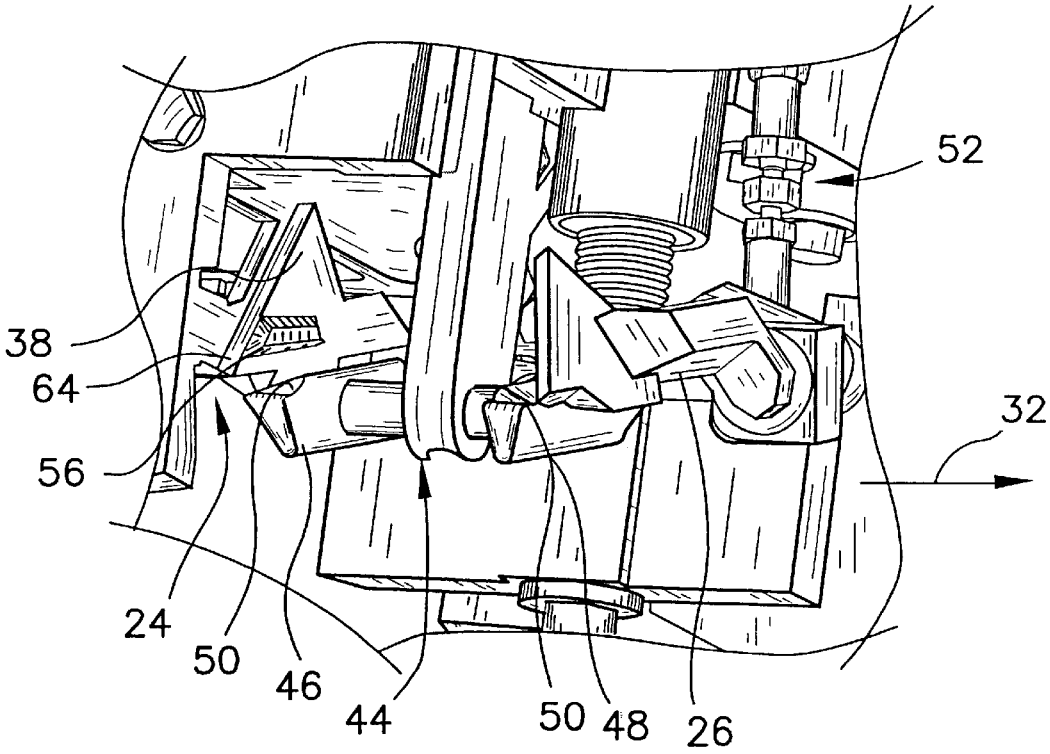
FIG. 3 is an enlarged view of one set of pre-folder flaps and an associated mandrel, the flaps being moved slightly inward of the initial carton engaging position.
Figure 2:
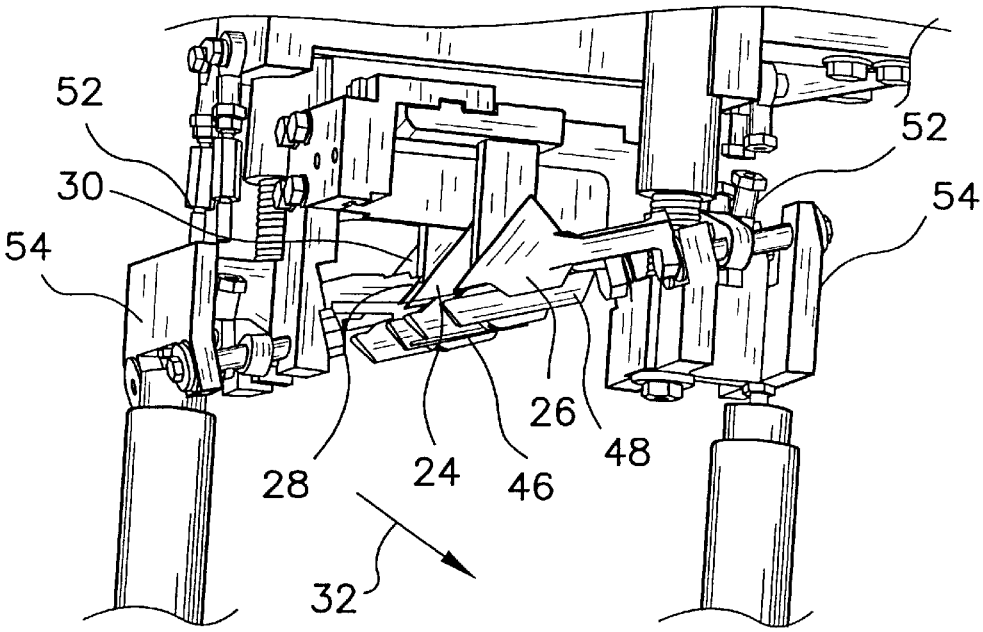
FIG. 2 is a partial perspective view of the enhanced top pre-folder apparatus.

Referring to FIGS. 1–3, the top pre-folder 18 is mounted within the form, fill and packaging machine 10 at a location subsequent to the bottom forming station 16 and prior to the filling station 22. The top pre-folder 18 includes a plurality of arms 24, 26, 28, 30 that pivot about axes A1–A2 (arms 24 and 26). The axes A1, A2 are angled relative to the horizontal H (FIG. 4*a*), but lie generally transverse to (i.e., across) the carton processing or travel path, indicated generally at 32 through the machine 10. In a preferred embodiment, the axes A1, A2 are aligned with the carton fold lines or creases 130 relative to the horizontal H.

The arms can be provided in pairs 24, 26 and 28, 30, with one pair 24, 26 lying on one side of the carton travel path 32 and another pair lying 28, 30 on an opposing side of the travel path 32. In this manner, while the axes A1, A2 of each of the arms 24, 26, 28, 30 are parallel to one another, one pair of arms 24, 26 is mounted on one side of the carton conveyance or travel path 32 while another pair of arms 28, 30 is mounted on the opposing side of the carton conveyance path 32.

Figure 4A:
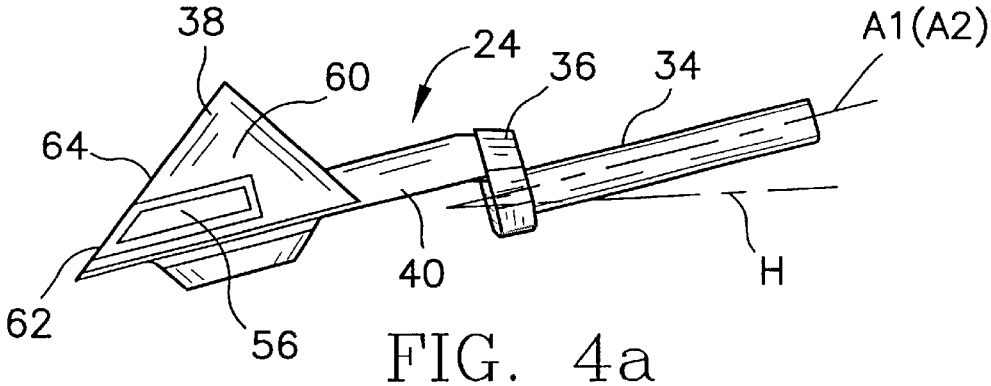
FIGS. 4*a* and 4*c* are plan views of the pre-folder flaps and their rotating mounting arms.

Referring now to FIGS. 4*a* and *b,* which figures illustrate arms 24 and 28, each arm 24, 28 includes a rod or pin 34, a transverse extension member 36 and a flap 38. A generally axially extending connecting member 40 extends between the flap 38 and the transverse extension member 36. As shown schematically in FIG. 4*c,* the arrangement radially displaces the rotation or movement of the flap 38 from the axis of rotation A1, A2 of the rod 34. This results in a relatively large arcuate path of travel, indicated generally at 42, of the flap 38 relative to the rotation of the rod 34.

A mandrel 44 is associated with each pair of arms 24, 26 and 28, 30. The mandrel 44 includes first and second mandrel heads 46, 48, each head being associated with one of the flaps of each pair of arms 24, 26 and 28, 30. For example, head 46 is associated with the flap 38 of arm 24 and head 48 is associated with the flap 38 of arm 26. The mandrel 44 is configured for insertion into the carton top so that the mandrel heads 46, 48 align with the fold lines 130 of the carton 110. The mandrel heads 46, 48 each include a fold edge 50.

As will be recognized by those skilled in the art from a study of FIGS. 2 and 3, a linkage 52 is provided for actuating both the pivoting or rotational movement of the arms 24, 26 and 28, 30 (and thus the movement of their respective flaps 38) as well as the reciprocating movement of the mandrels 44. In a current embodiment, the mandrel 44 and pivoting arms 24, 26 are mounted on a carriage 54 that reciprocates (e.g., moves upwardly and downwardly) to engage the cartons as the cartons move along the machine processing path 32.

Figure 7:
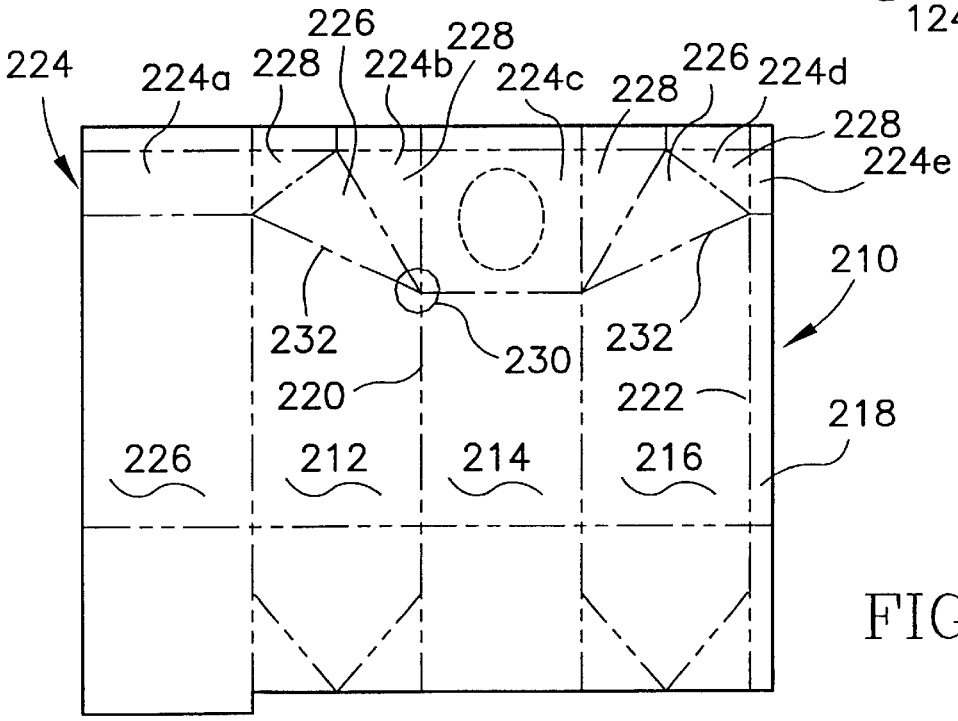
FIG. 7 is a plan view of a carton blank for the carton of FIG. 5*a*.

As best seen in FIGS. 3–4, each of the flaps 38 has a generally triangular shape that is complementary to the triangular shaped, inwardly oriented inner gable panels 226 (FIG. 7). Thus, the pre-folder flaps 38 engage essentially the entirety of the triangular gable panels 226 as the flaps 38 pivot or rotate inward. Referring to FIG. 7, and recognizing that during top panel pre-folding, the carton is otherwise fully formed (i.e., side sealed, and bottom folded and sealed), the inward pivoting of the triangular gable side panels 226 also urges inward the top minor panels 228, as well as the lesser top wall panel 120. Thus, the top panel pre-folding action pre-folds or breaks all of the upper panel 224*a–e* fold lines to facilitate proper subsequent top folding and sealing.

Each flap 38 is further provided with a raised section 56. The raised section 56 is configured for engaging the triangular gable panels 226 immediately adjacent and above the gable side panel/vertical side panel juncture 130. It has been found that the new, extended panel configuration requires a more positive or deeper pre-fold in order to provide neat, clean and distinct fold lines 130 for the gable panels 118, 120, 132, subsequent to filling and top sealing.

The mandrel heads 46, 48 are positioned in the interior of the carton as the arm/mandrel carriage 54 is moved downwardly. The head portions 46, 48 are positioned inside of the carton 110 adjacent the gable side panel/vertical side panel junctures 130. The heads 46, 48 provide support to the carton as the flaps 38 engage the carton to "break" the material along the crease lines (e.g. crease line 130), rather than at some unwanted location in the interior of a panel or wall section.

As discussed above, the flaps 38 are mounted to the arms rods by transverse and axial connecting members 36, 40. These connectors space the flaps 38 from the axis of rotation A1, A2 of the rods 34, resulting in an offset, as indicated at 58. When the flaps 38 are retracted, or rotated upwardly, out of engagement with the carton 110, the offset 58 provides sufficient space to move the arm 24, mandrel assembly 44 downwardly (i.e., move the carriage 54 downwardly) onto the carton 110 without interference with the carton or inadvertently crushing the carton panels.

Figure 6:
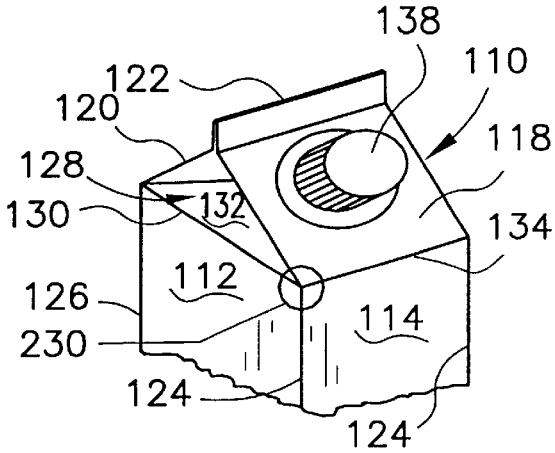
FIG. 6 is a perspective view of the top portion of the exemplary carton of FIG. 5*a*.

It has been observed that known top pre-folder arrangements fail to provide this increased folding motion to assure the formation of distinct, clean fold lines. In particular, a dimple was found to form at the corner defined by the intersection of the extended panel 118, the front panel 114, the vertical side panel 112 and the gable side panel 226(132), as indicated generally at 230 in FIGS. 6 and 7. To this end, the flap raised sections 56 that extend outwardly from a face 60 of the flap 38 have been found to increase the depth or angle of the pre-fold so as to ensure more clean, distinct creases at the gable fold lines 130, and to preclude unwanted dimple formation.

In a current embodiment, the raised sections 56 are formed by a planar raised face 62 that can be generally parallel to the face 60 of the flap 38. A rear edge 62 of each of the raised sections 56 is complimentary to a rear edge 64 of the flap 38. The raised sections 56 extend along a portion of the flap 38, from the rear edge 64 forward. For purposes of this description, the rear edge 64 of the flap 38 is that portion adjacent to the extended gable panel.

Figure 4B:
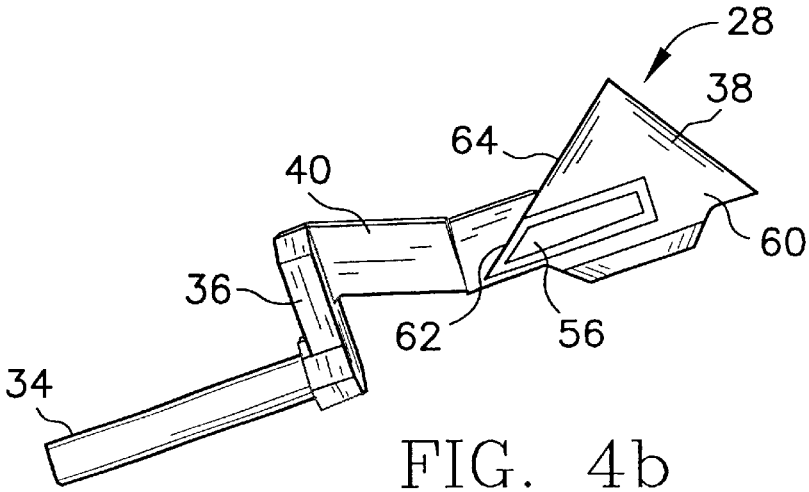
Figure 4C:
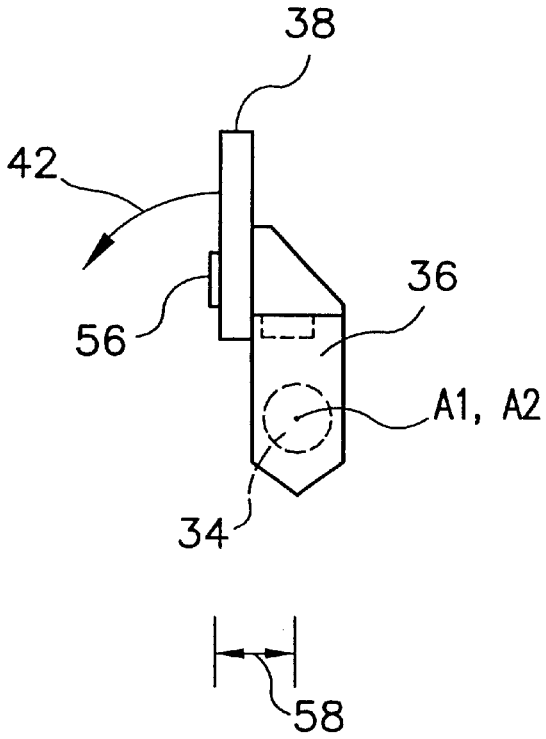
Figure 8:
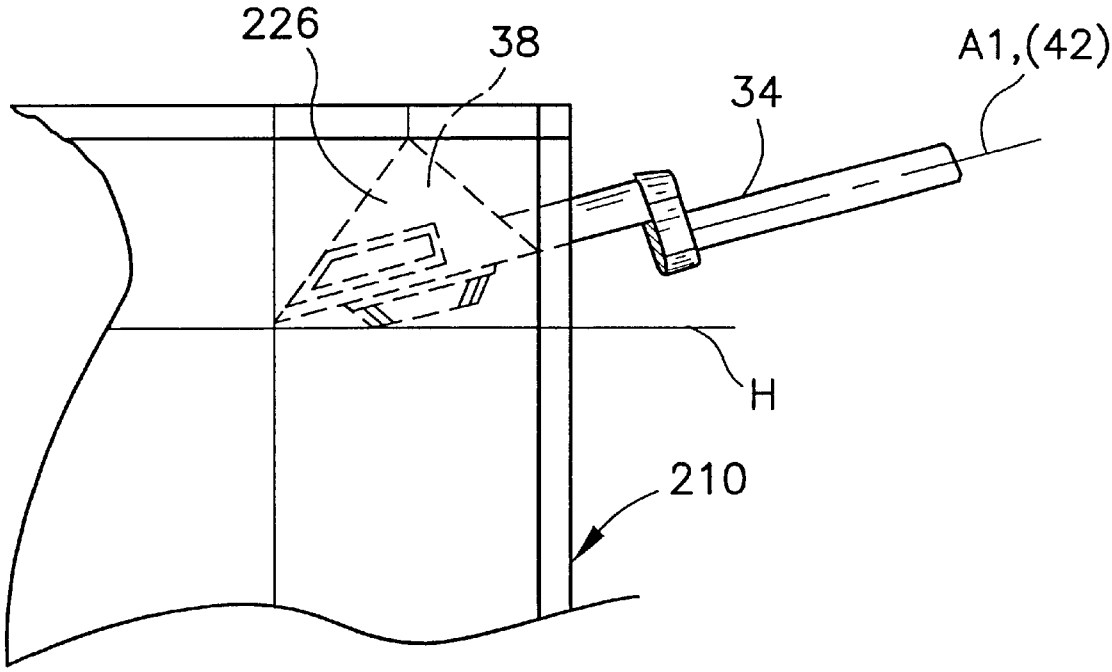
FIG. 8 is a perspective view of the pre-folder flaps and triangular cable side panel.

As can be seen from a study of the arms 24, 28 in FIGS. 4*a* and 4*b,* although the pins 34 of the arms 24, 28 extend from opposing sides of the respective flaps 38, the orientation of the flaps 38 is the same, as is the location of the raised sections 56 on the faces 60 of the flaps 38. As will be understood by those skilled in the art, the configuration is necessary when, as here, the cartons are processed with each carton in the same orientation as each other carton (i.e., all facing the same direction), and when, as here, there are a plurality of pre-folders 18 that are mounted on opposing sides of the carton processing path 32.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A top pre-folder for a form, fill and seal packaging machine for forming, filling and sealing a gable top carton, the machine defining a processing path, the top pre-folder disposed prior to a filling station along the machine, the gable top carton including a sealed bottom, pair of vertical side panels, and a pair of gable side panels, each of the gable side panels contiguous with a respective one of the vertical side panels defining a pair of gable side panel/vertical side panel junctures, the gable side panel/vertical side panel junctures being formed at an angle relative to the sealed bottom, the pre-folder comprising:

an mandrel positioned along the processing path and movable between a position above the carton and a position interior of the carton as the carton moves along the processing path; and a pair of spaced apart pivotal arms, each of the pair disposed on opposing sides of the mandrel and transverse to the processing path, each of the pivotal arms including a flap and being pivotal about an axis toward and away from the mandrel, each flap having a raised portion extending from a face of the flap, wherein the arms pivot to contact the flaps with the gable side panels to infold the gable side panels inwardly over the mandrels, and wherein the flap raised portions contact the gable side panels at about the gable side panel/vertical side panel junctures.

2. The top pre-folder in accordance with claim 1 wherein the flaps have a generally triangular shape.

3. The top pre-folder in accordance with claim 1 wherein the shape of the flaps is substantially the same as the shape of the gable side panels.

4. The top pre-folder in accordance with claim 1 wherein the pivotal arm axes are disposed at an angle relative to the horizontal.

5. The top pre-folder in accordance with claim 4 wherein the pivotal arm axes are disposed at an angle about equal to the angle at which the gable side panel/vertical side panel junctures are formed relative to the sealed bottom.

6. The top pre-folder in accordance with claim 1 wherein the mandrel defines a pair of head portions.

7. The top pre-folder in accordance with claim 6 wherein the mandrel head portions each define a fold line an wherein the fold lines are generally parallel to their respective pivotal arm axes.

8. The top pre-folder in accordance with claim 1 wherein the machine includes first and second pairs of pivotal arms and wherein the first and second pairs are disposed on opposing sides of the processing path.

9. The top pre-folder in accordance with claim 1 wherein the pivotal arms and the mandrel are carried by a reciprocating carriage for unitarily moving the pivotal arms and carriage into and out of engagement with the cartons.

10. The top pre-folder in accordance with claim 9 wherein the carriage is configured to reciprocate vertically.

* * * * *